US008233017B2

(12) United States Patent
Law et al.

(10) Patent No.: US 8,233,017 B2
(45) Date of Patent: Jul. 31, 2012

(54) DIGITAL ELECTROSTATIC LATENT IMAGE GENERATING MEMBER

(75) Inventors: Kock-Yee Law, Penfield, NY (US); Mandakini Kanungo, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 452 days.

(21) Appl. No.: 12/539,397

(22) Filed: Aug. 11, 2009

(65) Prior Publication Data

US 2011/0039201 A1 Feb. 17, 2011

(51) Int. Cl.
*B41J 2/39* (2006.01)
*G03G 13/20* (2006.01)

(52) U.S. Cl. ..... 347/141; 430/124.1

(58) Field of Classification Search ..... 430/124.1
See application file for complete search history.

(56) References Cited

U.S. PATENT DOCUMENTS

| | | | | |
|---|---|---|---|---|
| 4,620,203 | A | 10/1986 | Nakatani et al. | |
| 5,640,189 | A | 6/1997 | Ohno et al. | |
| 6,013,403 | A | 1/2000 | Ichikawa | |
| 6,100,909 | A * | 8/2000 | Haas et al. | 347/141 |
| 2006/0103694 | A1 * | 5/2006 | Nguyen | 347/47 |

OTHER PUBLICATIONS

"Products" page www.teijindupontfilms.jp/englis/product/index.html from Teijin DuPont Films website printed on Apr. 12, 2012, 2 pages.

Polyethylene Terephthalate in the "Glossary of Technical Terms & Acronyms" from www2.dupont.com printed on Apr. 12, 2012, 3 pages.

DuPont Teijin Films, Material Safety Data Sheet, Oct. 26, 2009, pp. 1-9.

* cited by examiner

*Primary Examiner* — Stephen Meier
*Assistant Examiner* — Alexander C Witkowski
(74) *Attorney, Agent, or Firm* — MH2 Technology Law Group LLP

(57) ABSTRACT

Provided are electrostatic latent image generators, printing apparatuses including the electrostatic latent image generators, and methods of forming an electrostatic latent image. The electrostatic latent image generator can include a substrate and an array of pixels disposed over the substrate, wherein each pixel of the array of pixels can include a layer of one or more nano-carbon materials, and wherein each pixel of the array of pixels is electrically isolated and is individually addressable. The electrostatic latent image generator can also include a charge transport layer disposed over the array of pixels, wherein the charge transport layer can include a surface disposed opposite to the array of pixels, and wherein the charge transport layer is configured to transport holes provided by the one or more pixels to the surface.

24 Claims, 5 Drawing Sheets

DIGITAL ELECTROSTATIC LATENT IMAGE GENERATING MEMBER

RELATED APPLICATION

Reference is made to copending, commonly assigned U.S. patent application to Law et al., filed Aug. 11, 2009, entitled, "Digital Electrostatic Latent Image Generating Member" Ser. No. 12/539,557, the disclosure of which is incorporated by reference herein in its entirety.

FIELD OF USE

The present teachings relate to electrostatography and electrophotography and, more particularly, to digital electrostatic latent image generators and methods of making them.

BACKGROUND

Current xerographic printing involves multiple steps, such as, for example, charging of the photoreceptor and forming a latent image on the photoreceptor; developing the latent image; transferring and fusing the visible image onto a media; and erasing and cleaning the photoreceptor. There is a drive in the printing industry towards smaller, faster, smarter, lower cost (unit manufacturing cost (UMC) and run cost), and more energy efficient/green printing apparatuses. However, to achieve this, a new engine design and/or architecture are needed. Hence, a printing apparatus with a new electrostatic latent image generating member which can generate an electrostatic latent image digitally without using a ROS and a photoreceptor but with or without a charger, can enable digitization of the xerographic marking process. The use of the electrostatic latent image generating member should also result in smaller, smarter printing apparatuses with breakthrough UMC reduction due to less number of components and large scale nano manufacturing.

Accordingly, there is a need to overcome these and other problems of prior art to provide new electrostatic latent image generators and methods of making them.

SUMMARY

In accordance with various embodiments, there is an electrostatic latent image generator including a substrate and an array of pixels disposed over the substrate, wherein each pixel of the array of pixels can include a layer of one or more nano-carbon materials, and wherein each pixel of the array of pixels is electrically isolated and is individually addressable. The electrostatic latent image generator can also include a charge transport layer disposed over the array of pixels, wherein the charge transport layer can include a surface disposed opposite to the array of pixels, and wherein the charge transport layer is configured to transport holes provided by the one or more pixels to the surface.

According to various embodiments, there is a method of forming an electrostatic latent image. The method can include providing an electrostatic latent image generator, the electrostatic latent image generator including an array of pixels disposed over a substrate and a charge transport layer disposed over the array of pixels, wherein each pixel of the array of pixels is electrically isolated, individually addressable, and comprises a layer of one or more nano-carbon materials. The method can also include creating a negative surface charge on a surface of the charge transport layer, the surface being disposed on a side opposite to the array of pixels and individually addressing one or more pixels to discharge the negative surface charge on the surface of the charge transport layer corresponding to the one or more pixels, wherein the one or more nano-carbon materials of the one or more addressed pixels inject holes at the interface of the one or more pixels and the charge transport layer and the charge transport layer transport the holes to the surface.

According to another embodiment, there is a method of forming an electrostatic latent image. The method can include providing an electrostatic latent image generator, the electrostatic latent image generator including an array of pixels disposed over a substrate and a charge transport layer disposed over the array of pixels, wherein each pixel of the array of pixels is electrically isolated, individually addressable, and includes a layer of one or more nano-carbon materials, and wherein each pixel of the array of pixels is connected to a thin film transistor of an array of thin film transistors. The method can also include applying an electrical bias to each thin film transistor of the array of thin film transistors to either enable or disable each pixel to inject holes at the interface of each pixel and the charge transport layer, such that a surface negative charge develops at the surface of the charge transport layer corresponding to the disabled pixel.

Additional advantages of the embodiments will be set forth in part in the description which follows, and in part will be obvious from the description, or may be learned by practice of the present teachings. The advantages will be realized and attained by means of the elements and combinations particularly pointed out in the appended claims.

It is to be understood that both the foregoing general description and the following detailed description are exemplary and explanatory only and are not restrictive of the present teachings, as claimed.

The accompanying drawings, which are incorporated in and constitute a part of this specification, illustrate embodiments of the present teachings and together with the description, serve to explain the principles of the present teachings.

DESCRIPTION OF THE EMBODIMENTS

Reference will now be made in detail to the present embodiments, examples of which are illustrated in the accompanying drawings. Wherever possible, the same reference numbers will be used throughout the drawings to refer to the same or like parts.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less that 10" can assume negative values, e.g. −1, −2, −3, −10, −20, −30, etc.

Figure 1:
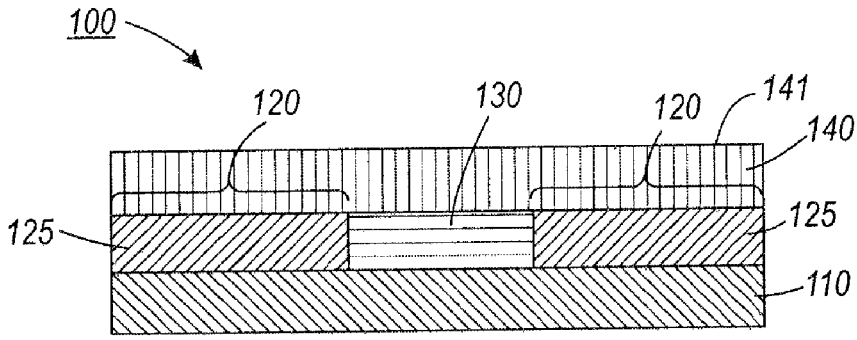
FIG. 1 schematically illustrates a cross sectional view of a portion of an exemplary electrostatic latent image generator, according to various embodiments of the present teachings.

FIG. 1 schematically illustrates a cross sectional view of a portion of an exemplary electrostatic latent image generator 100, according to various embodiments of the present teachings. The electrostatic latent image generator 100 can include a substrate 110 and an array of pixels 120 disposed over the substrate 110, such that each pixel 125 of the array of pixels 120 is electrically isolated and is individually addressable. The phrase "individually addressable" as used herein means that each pixel of an array of pixels can be identified and manipulated independently of its surrounding pixel. For example, referring to FIG. 1, each pixel 125 can be individually turned on or off independently of its surrounding pixel 125 or each pixel 125 can have a bias different from its surrounding pixel 125. However in some embodiments, instead of addressing the pixels 125 individually, a group (subset) of pixels 125 including two or more pixels 125 can be addressed together, i.e. a group of pixels 125 can be turned on or off together or applied a certain bias independently from the other pixels 125 or other groups of pixels 125. In various embodiments, each pixel 125 of the array of pixels 120 can include a layer of one or more nano-carbon materials. In some cases, the layer of one or more nano-carbon materials can have a surface resistivity in the range of about 50 ohm/sq. to about 5,000 ohm/sq. and in other cases in the range of about 100 ohm/sq. to about 2,000 ohm/sq. The nano-carbon materials act as the hole injection materials for the electrostatic generation of latent images. One of the advantages of using nano-carbon materials as hole injection materials is that nano-carbon materials can be easily patterned by various nanofabrication techniques. As used herein, the phrase "nano-carbon material" refers to carbon nanotubes including single-wall carbon nanotubes (SWNT), double-wall carbon nanotubes (DWNT), and multi-wall carbon nanotubes (MWNT); functionalized carbon nanotubes; and graphenes and functionalized graphenes, wherein graphene is a single planar sheet of $sp^2$-hybridized bonded carbon atoms that are densely packed in a honeycomb crystal lattice and is exactly one atom in thickness with each atom being a surface atom. One of ordinary skill in the art would know that as-synthesized carbon nanotubes after purification is a mixture of carbon nanotubes structurally with respect to number of walls, diameter, length, chirality, and defect rate. It is the chirality that dictates whether the carbon nanotube is metallic or semiconductor. Statistically, one can get about 33% metallic carbon nanotubes. Carbon nanotubes can have a diameter from about 0.5 nm to about 50 nm and in some cases from about 1.0 nm to about 10 nm and can have a length from about 10 nm to about 5 mm and in some cases from about 200 nm to about 10 μm. In certain embodiments, the concentration of carbon nanotubes in the layer of one or more nano-carbon materials can be from about 0.5 weight % to about 99 weight % and in some cases can be from about 0.5 weight % to about 50 weight % and in some other cases from about 1 weight % to about 20 weight %.

In various embodiments, each pixel 125 of the array of pixels 120 can include a thin layer of carbon nanotubes. In some embodiments, the thin layer of carbon nanotubes can include a solvent coatable carbon nanotube layer. One of ordinary skill in the art would know that the solvent coatable carbon nanotube layer can be coated from an aqueous dispersion or an alcoholic dispersion of carbon nanotubes wherein the carbon nanotubes can be stabilized by a surfactant or a DNA or a polymeric material. In other embodiments, the thin layer of carbon nanotubes can include a carbon nanotube composite, including but not limited to carbon nanotube polymer composite and carbon nanotube filled resin. Any suitable method like dip coating, spray coating, spin coating, web coating, draw down coating, flow coating, and extrusion die coating can be used for depositing a thin layer of carbon nanotubes over the substrate 110. In various embodiments, the array of pixels 120 can be formed by first forming a layer of nano-carbon materials and then creating a pattern or an array of pixels 120 using a suitable nano-fabrication technique, such as, for example, photolithography, etching, nano-imprinting, and inkjet printing. Since CNT films are known to be patternable from nano to micron scales by a variety of fabrication techniques, each pixel 125 of the array of pixels 120 can have at least one of length and width from about 100 nm to about 150 μm, and in some cases from about 1 μm to about 100 μm. Any suitable material can be used for the substrate 110 including, but not limited to, bi-axially oriented polyethylene terephthalate (commercially available as MYLAR® from Teijin DuPont Films of Chester, Va.), polyimide (PI), poly(ethylene napthalate) (PEN), and flexible glass.

The electrostatic latent image generator 100, as shown in FIG. 1 can also include a charge transport layer 140 disposed over the array of pixels 120, wherein the charge transport layer 140 can include a surface 141 disposed opposite to the array of pixels 120. One of ordinary skill in the art would know that charge transport layer can include materials capable of transporting either holes or electrons through the charge transport layer to selectively dissipate a surface charge. As used herein, the phrases "charge transport", "charge transport material", and "charge transport layer" are used interchangeably with the phrases "hole transport", "hole transport material", and "hole transport layer" respectively. In various embodiments, the charge transport layer 140 can be configured to transport holes injected by the one or more pixels 125 to the surface 141. In certain embodiments, the charge transport layer 140 can include a charge transporting small molecule dissolved or molecularly dispersed in a film forming electrically inert polymer. The term "dissolved" as used herein is defined herein as forming a solution in which the small molecule is dissolved in the polymer to form a homogeneous phase. The expression "molecularly dispersed" is used herein is defined as a charge transporting small molecule dispersed in the polymer, the small molecules being dispersed in the polymer on a molecular scale. Any suitable charge transporting or electrically active small molecule may be employed in the charge transport layer 140, 240. The expression charge transporting "small molecule" is defined herein as a monomer that allows the free holes generated at the interface of the charge transport layer and the pixel 125 to be transported across the charge transport layer 140. Exemplary charge transporting small molecules can include, but are not limited to, pyrazolines such as, for example, 1-phenyl-3-(4'-diethylaminostyryl)-5-(4"-diethylamino phenyl)pyrazoline; diamines such as, for example, N,N'-diphenyl-N,N'-bis(3-methylphenyl)-(1,1'-biphenyl)-4,4'-diamine (TPD); other arylamines like triphenyl amine, N,N,N',N'-tetra-p-tolyl-1,1'-biphenyl-4,4'-diamine (TM-TPD); hydrazones such as, for example, N-phenyl-N-methyl-3-(9-ethyl)carbazyl hydrazone and 4-diethyl amino benzaldehyde-1,2-diphenyl hydrazone; oxadiazoles such as, for example, 2,5-bis(4-N,N'-diethylaminophenyl)-1,2,4-oxadiazole; stilbenes; aryl amines; and the like. Exemplary aryl amines can have the following formulas/structures:

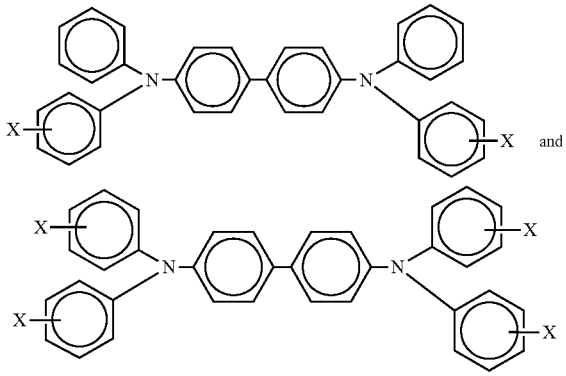

and wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas

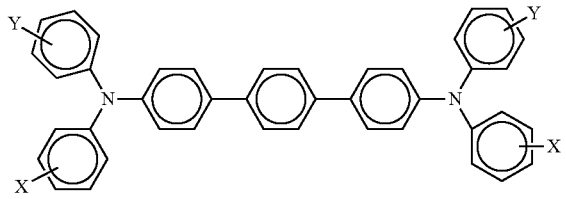

and

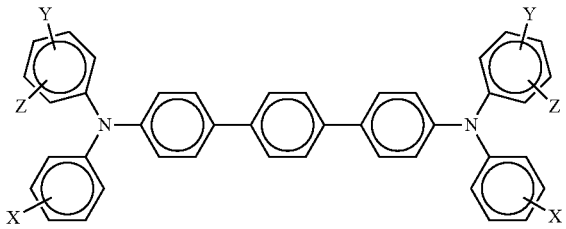

wherein X, Y and Z are independently alkyl, alkoxy, aryl, a halogen, or mixtures thereof, and wherein at least one of Y and Z are present.

Alkyl and alkoxy groups can include, for example, from 1 to about 25 carbon atoms, and more specifically, from 1 to about 12 carbon atoms, such as methyl, ethyl, propyl, butyl, pentyl, and the corresponding alkoxides. Aryl group can include from 6 to about 36 carbon atoms, such as phenyl, and the like. Halogen includes chloride, bromide, iodide, and fluoride. Substituted alkyls, alkoxys, and aryls can also be selected in various embodiments.

Examples of specific aryl amines that can be used for the charge transport layer 140 include, but are not limited to, N,N'-diphenyl-N,N'-bis(alkylphenyl)-1,1'-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Any other known charge transport layer molecules can be selected such as, those disclosed in U.S. Pat. Nos. 4,921,773 and 4,464,450, the disclosures of which are incorporated by reference herein in their entirety.

As indicated above, suitable electrically active small molecule charge transporting compounds are dissolved or molecularly dispersed in electrically inactive polymeric film forming materials. If desired, the charge transport material in the charge transport layer 140 can include a polymeric charge transport material or a combination of a small molecule charge transport material and a polymeric charge transport material. Any suitable polymeric charge transport material can be used, including, but not limited to, poly(N-vinylcarbazole); poly(vinylpyrene); poly(-vinyltetraphene); poly(vinyltetracene) and poly(vinylperylene).

Any suitable electrically inert polymer can be employed in the charge transport layer 140. Typical electrically inert polymer can include polycarbonates, polyarylates, acrylate polymers, vinyl polymers, cellulose polymers, polyesters, polysiloxanes, polyamides, polyurethanes, poly(cyclo olefins), polysulfone, and epoxies, and random or alternating copolymers thereof. However, any other suitable polymer can also be utilized in the charge transporting layer 140 such as those listed in U.S. Pat. No. 3,121,006, the disclosure of which is incorporated by reference herein in its entirety.

In various embodiments, the charge transport layer 140 can include optional one or more materials to improve lateral charge migration (LCM) resistance, including, but not limited to, hindered phenolic antioxidants, such as, for example tetrakis methylene(3,5-di-tert-butyl-4-hydroxy hydrocinnamate) methane (IRGANOX® 1010, available from Ciba Specialty Chemical, Tarrytown, N.Y.), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical America, Inc., New York, N.Y.), IRGANOX® 1035, 1076, 1098, 1135, 1141, 1222, 1330, 1425WL, 1520L, 245, 259, 3114, 3790, 5057 and 565 (available from Ciba Specialties Chemicals, Tarrytown, N.Y.), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SANKYO CO., Ltd.), TINUVIN® 144 and 622LD (available from Ciba Specialties Chemicals, Tarrytown, N.Y.), MARK™ LA57, LA67, LA62, LA68 and LA63 (available from Amfine Chemical Corporation, Upper Saddle River, N.J.), and SUMILIZER® TPS (available from Sumitomo Chemical America, Inc., New York, N.Y.); thioether antioxidants such as SUMILIZER® TP-D (available from Sumitomo Chemical America, Inc., New York, N.Y.); phosphite antioxidants such as MARK™ 2112, PEP-8, PEP-24G, PEP-36, 329K and HP-10 (available from Amfine Chemical Corporation, Upper Saddle River, N.J.); other molecules such as bis(4-diethylamino-2-methylphenyl)phenylmethane (BDETPM), bis-[2-methyl-4-(N-2-hydroxyethyl-N-ethyl-aminophenyl)]-phenylmethane (DHTPM), and the like. The charge transport layer 140 can have antioxidant in an amount ranging from about 0 to about 20 weight %, from about 1 to about 10 weight %, or from about 3 to about 8 weight %.

The charge transport layer 140 including charge transport material dispersed in an electrically inert polymer can be an insulator to the extent that the electrostatic charge placed on the charge transport layer 140 is not conducted at a rate sufficient to prevent formation and retention of an electrostatic latent image thereon. The charge transport layer 140 is electrically "active" in that it allows the injection of holes from the carbon nanotube injection layer 125, and allows these holes to be transported through itself to enable selective discharge of a negative surface charge on the surface 141 of the charge transport layer 140.

Any suitable and conventional technique may be utilized to form and thereafter apply the charge transport layer 140 mixture over the array of pixels 125. The charge transport layer 140 can be formed in a single coating step or in multiple coating steps. Typical application techniques include spraying, dip coating, roll coating, wire wound rod coating, ink jet coating, ring coating, gravure, drum coating, and the like.

Drying of the deposited coating can be effected by any suitable conventional technique such as oven drying, infra red radiation drying, air drying and the like. The charge transport layer 140 after drying can have a thickness in the range of about 10 μm to about 50 μm, but can also have thickness outside this range.

Figure 2:
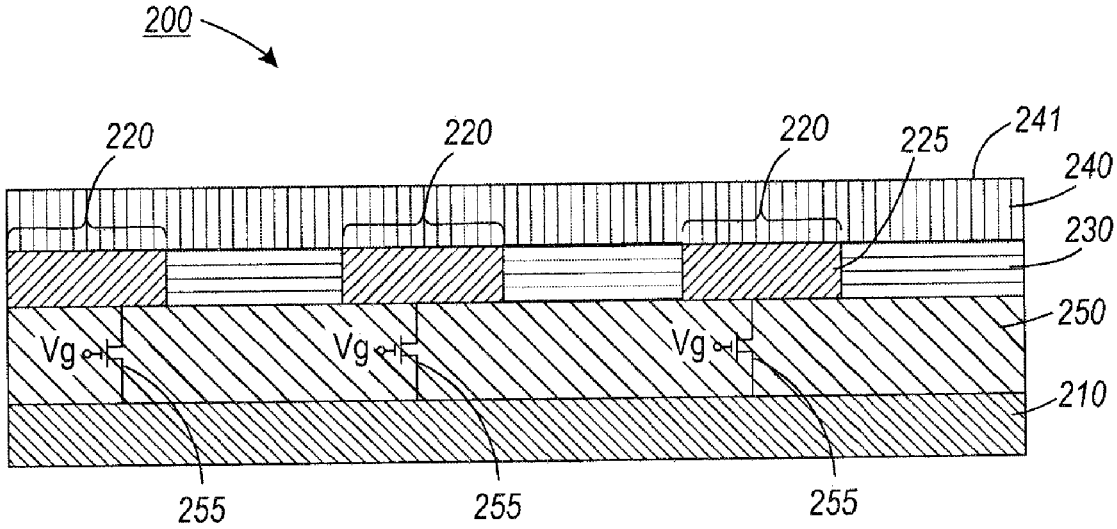
FIG. 2 schematically illustrates a cross sectional view of a portion of another exemplary electrostatic latent image generator, in accordance with various embodiments of the present teachings.

FIG. 2 schematically illustrates a cross sectional view of a portion of another exemplary electrostatic latent image generator 200, according to various embodiments of the present teachings. The exemplary electrostatic latent image generator 200 can include a substrate 210 and an array of pixels 220 disposed over the substrate 210, such that each pixel 225 of the array of pixels 220 is electrically isolated and is individually addressable. The exemplary electrostatic latent image generator 200 can also include an array of thin film transistors 250 disposed over the substrate 210, such that each thin film transistor 255 can be coupled to one pixel 225 of the array of pixels 220. The exemplary electrostatic latent image generator 200 can further include a charge transport layer 240 disposed over the array of pixels 220, wherein the charge transport layer 240 can include a surface 241 disposed opposite to the array of pixels 220. The charge transport layer 240 can be configured to transport holes provided by the one or more pixels 125 to the surface 241.

Figure 3:
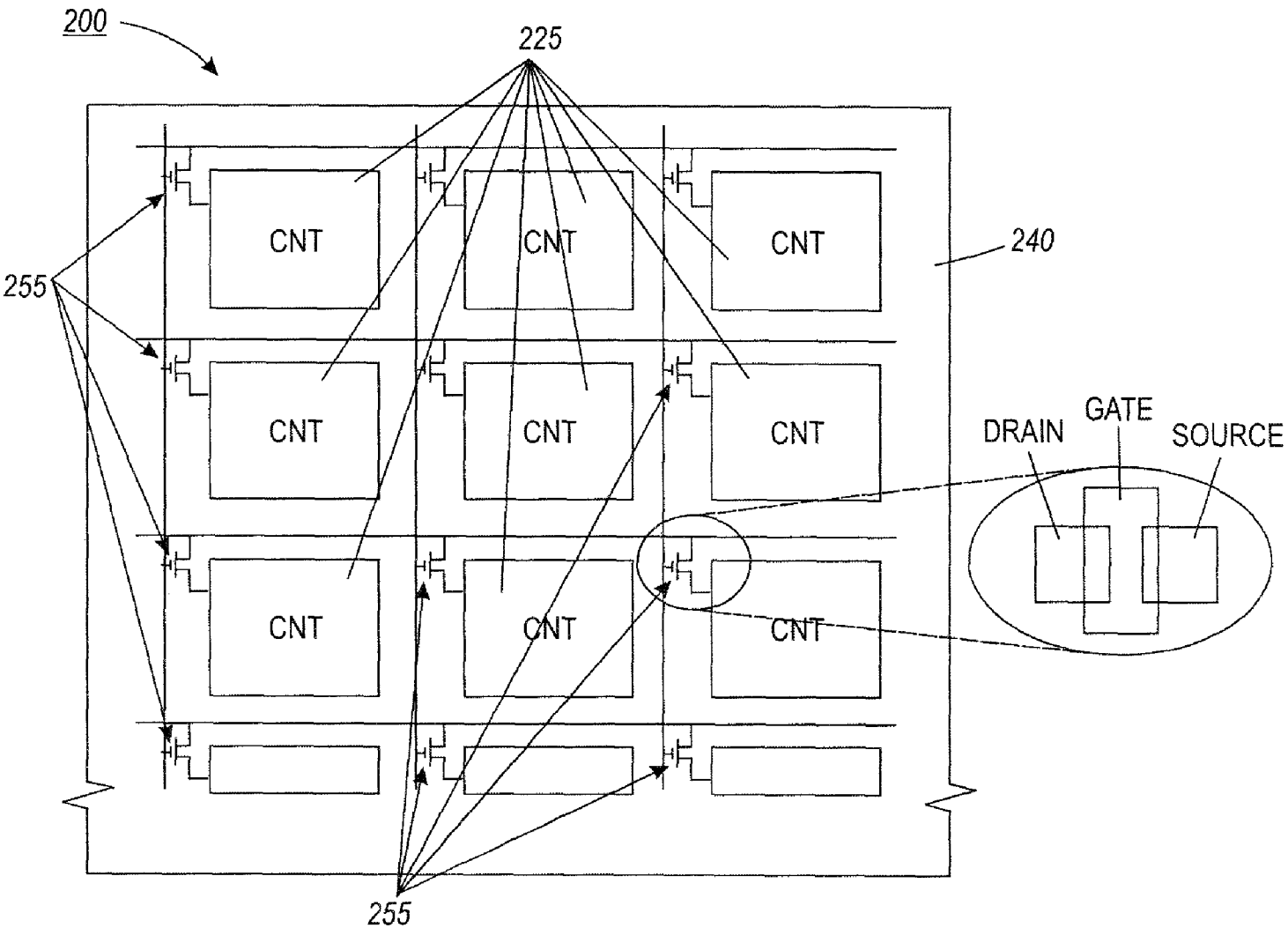
FIG. 3 schematically illustrates a top view of a portion of the exemplary electrostatic latent image generator shown in FIG. 2, in accordance with various embodiments of the present teachings.

A top view of the exemplary electrostatic latent image generator 200 shown in FIG. 2, is schematically illustrated in FIG. 3. As shown in FIG. 3, each pixel 225 is connected to a thin film transistor 255 and the charge transport layer 240 is disposed over the pixels 225.

Figure 4:
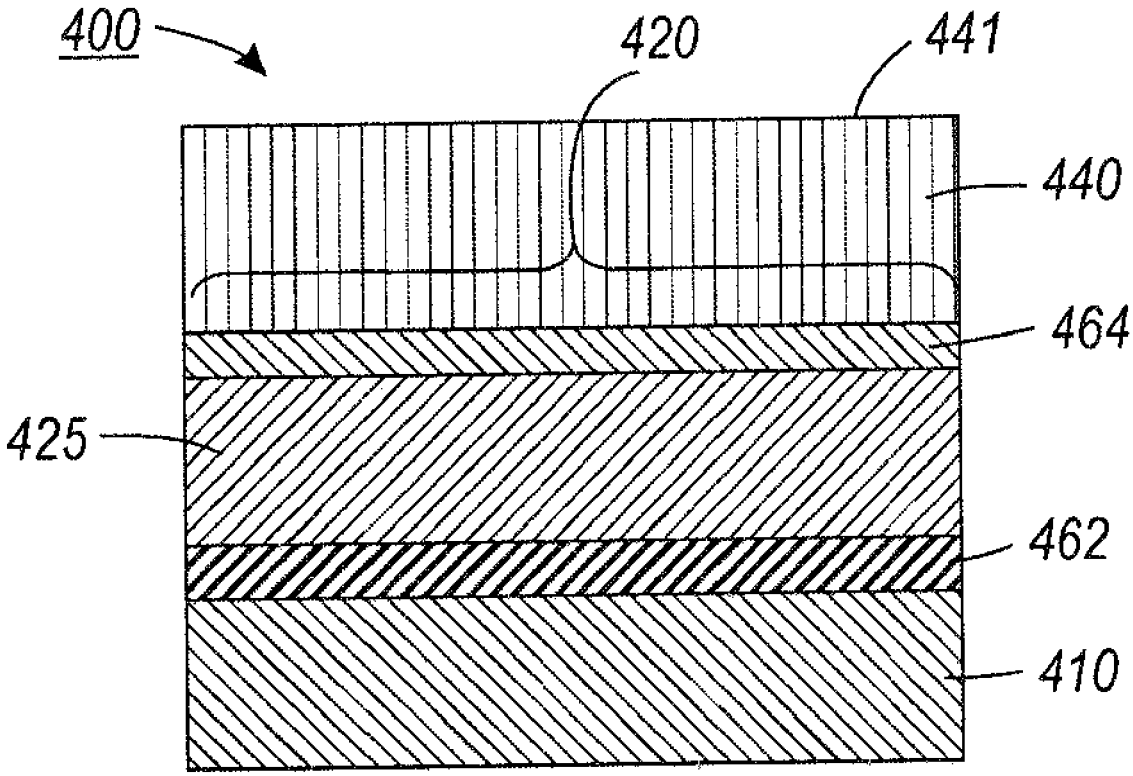
FIG. 4 schematically illustrates a cross sectional view of a portion of another exemplary electrostatic latent image generator, in accordance with various embodiments of the present teachings.

FIG. 4 schematically illustrates a cross sectional view of a portion of another exemplary electrostatic latent image generator 400, in accordance with various embodiments of the present teachings. The electrostatic latent image generator 400 can include an optional adhesion layer 462 disposed between the substrate 410 and the pixel 425. The pixel 425 can include a layer of one or more nano-carbon materials. Exemplary polyester resins which may be utilized for the optional adhesion layer 462 include polyarylatepolyvinylbutyrals, such as, U-100 available from Unitika Ltd., Osaka, JP; VITEL PE-100, VITEL PE-200, VITEL PE-200D, and VITEL PE-222, all available from Bostik, Wauwatosa, Wis.; MOR-ESTER™ 49000-P polyester available from Rohm Hass, Philadelphia, Pa.; polyvinyl butyral; and the like. The electrostatic latent image generator 400 can also include also include an optional hole blocking layer 464 disposed over the layer 425 of one or more nano-carbon materials and a charge transport layer 440 disposed over the optional hole blocking layer 464, as shown in FIG. 4. In some embodiments, an optional adhesion layer (not shown) can be disposed between the charge transport layer 440 and the hole blocking layer 464 and/or between the hole blocking layer 464 and the pixel 425 including the layer of one or more nano-carbon materials.

The hole blocking layer 464 can include polymers such as, for example, polyvinylbutryral, epoxy resins, polyesters, polysiloxanes, polyamides, polyurethanes and the like; nitrogen containing siloxanes or nitrogen containing titanium compounds such as, for example, trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl)titanate, isopropyl di(4-aminobenzoyl)isostearoyl titanate, isopropyl tri(N-ethylamino-ethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl)methyl diethoxysilane, and $[H_2N(CH_2)_3]CH_3Si(OCH_3)_2$ (gamma-aminopropyl)methyl diethoxysilane, as disclosed in U.S. Pat. Nos. 4,338,387, 4,286,033 and 4,291,110, the disclosures of which are incorporated by reference herein in their entirety. The hole blocking layer 464 can have a thickness in the range of about 0.005 μm to about 0.5 μm and in some cases from about 0.01 μm to about 0.1 μm and in some other cases from about 0.03 μm and about 0.06 μm.

Figure 5A:
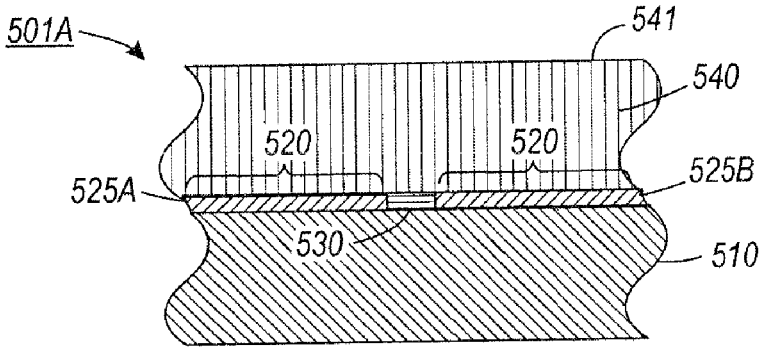
FIGS. 5A-5D schematically illustrates an exemplary method of forming an electrostatic latent image, according to various embodiments of the present teachings.

In accordance with various embodiments, there is a method of forming an electrostatic latent image, schematically illustrated in FIGS. 5A-5D. The method can include a step of providing an electrostatic latent image generator 501A, as schematically illustrated in FIG. 5A. The electrostatic latent image generator 501A can include an array of pixels 520 disposed over a substrate 510 and a charge transport layer 540 disposed over the array of pixels 520, wherein each pixel 525A, 525B of the array of pixels 520 is electrically isolated by an insulated area 530 and is individually addressable. In various embodiments, each pixel 525A, 525B of the array of pixels 520 can include a layer of one or more nano-carbon materials. In some embodiments, the one or more nano-carbon materials can include one or more of a plurality of single-wall carbon nanotubes (SWNT), a plurality of double-wall carbon nanotubes (DWNT), and a plurality of multi-wall carbon nanotubes (MWNT). In other embodiments, the one or more nano-carbon materials can include graphenes.

Figure 5B:
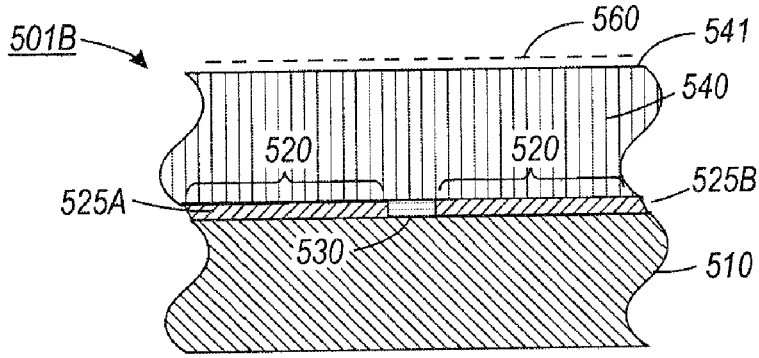

The method of forming an electrostatic latent image can also include creating a negative surface charge 560 on a surface 541 of the charge transport layer 540, the surface 541 being disposed on a side opposite to the array of pixels 520. FIG. 5B schematically illustrates a portion of an electrostatic latent image generator 501B having a negative surface charge 560 on the surface 541 of the charge transport layer 540. The surface charge 560 can be applied using any suitable method, such as, for example, by applying an appropriate electrical bias or using a charger, such as, for example, a corotron.

Figure 5C:
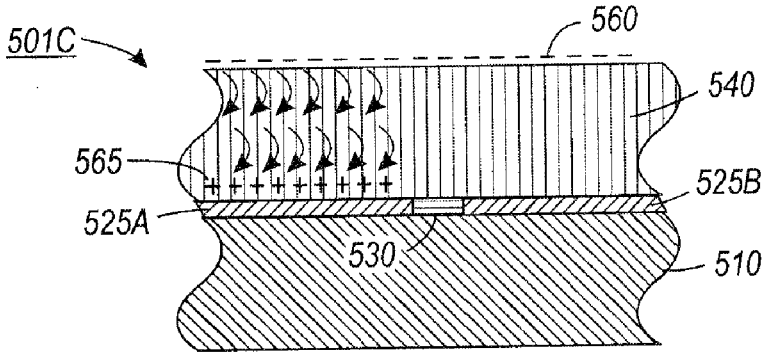
Figure 5D:
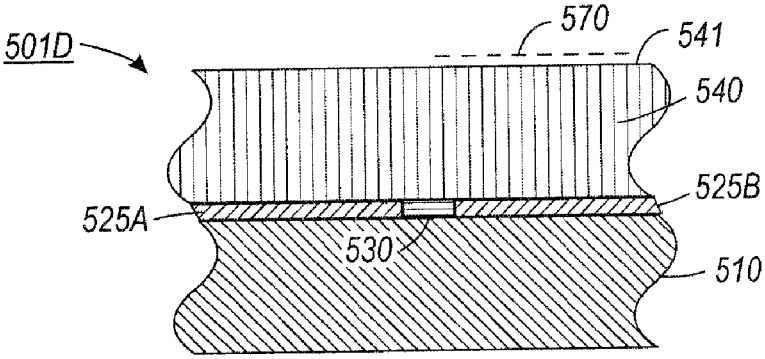

The method can further include individually addressing one or more pixels 525A, 525B to discharge the negative surface charge 560 on the surface 541 of the charge transport layer 540 corresponding to the one or more pixels 525A, 525B. FIG. 5C schematically illustrates a portion of the electrostatic latent image generator 501C, wherein the pixel 525A is addressed and a bias is applied, whereas no bias is applied to the pixel 525B. As a result of the application of bias to the pixel 525A, the one or more nano-carbon materials disposed in the pixel 525A inject holes 565 at the interface of the pixel 525A and the charge transport layer 540. As shown in FIG. 5C, the charge transport layer 540 transports the holes 565 to the surface 541 to neutralize the negative surface charge 560 to create a latent image 570. FIG. 5D schematically illustrates a portion of the electrostatic latent image generator 501D comprising a latent image 570 formed by individually addressing one or more pixels 525A, 525B to discharge the negative surface charge 560 on the surface 541 of the charge transport layer 540 corresponding to the one or more pixels 525A, 525B.

In some embodiments, the electrostatic latent image generator 410A, 501B, 501C, 501D can include an array of thin film transistors 250 disposed over the substrate 510, such that each thin film transistor 255 can be connected to one pixel 525A, 525B of the array of pixels 520, as shown in FIGS. 2 and 3. In various embodiments, step of forming an electrostatic latent image 570 on the surface 541 of the charge transport layer 540 by individually addressing one or more pixels 525A, 525B can include applying an electrical bias to one or more pixels 525A, 525B via thin film transistors to either enable hole injection or disable hole injection at the interface of the one or more pixels 525A, 525B and the charge transport layer 540 to form the electrostatic latent image 570 pixel 525A, 525B by pixel 525A, 525B.

Figure 6A:
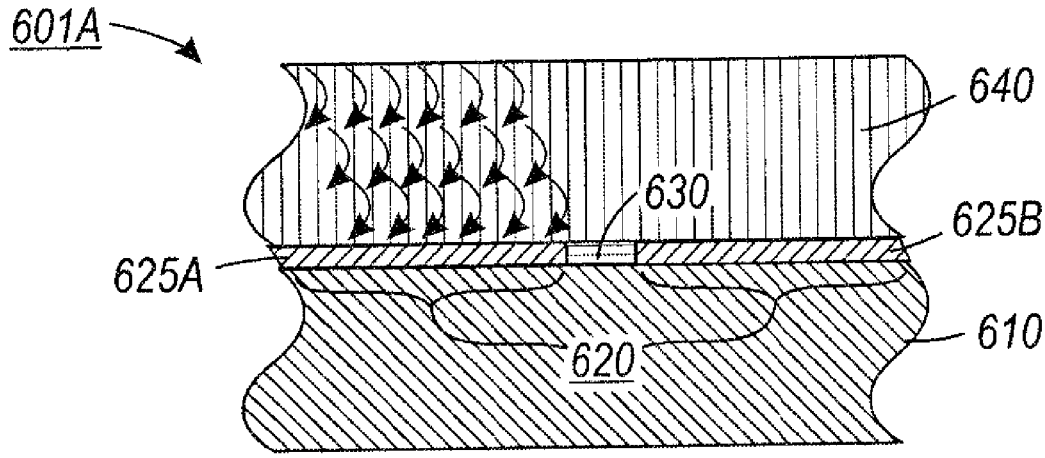
FIGS. 6A and 6B schematically illustrate another exemplary method of forming an electrostatic latent image, according to various embodiments of the present teachings.
Figure 6B:
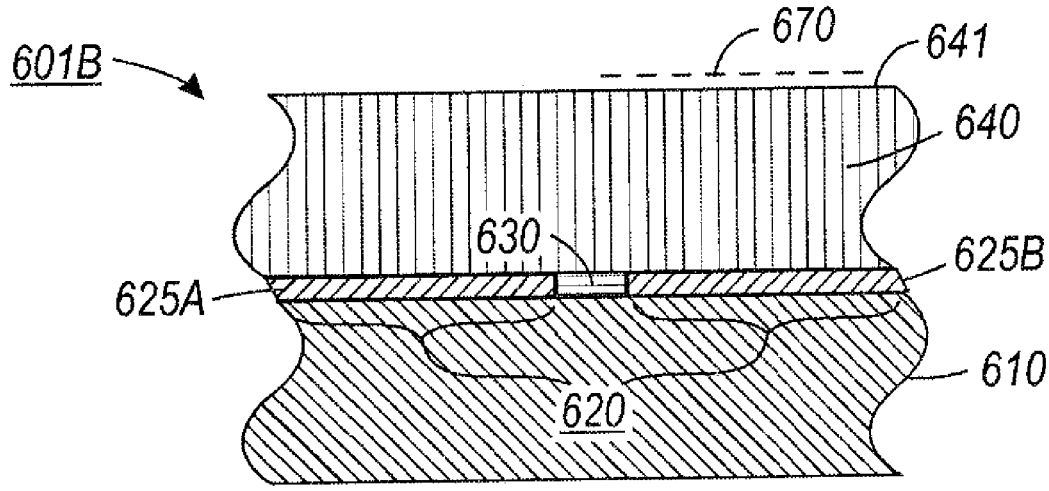

FIGS. 6A and 6B schematically illustrate another method of forming an electrostatic latent image, in accordance with various embodiments of the present teachings. The method can include providing an electrostatic latent image generator 601A, 601B. In various embodiments, the electrostatic latent image generator 601A, 601B can include an array of pixels 620 disposed over a substrate 610 and a charge transport layer 640 disposed over the array of pixels 620, wherein each pixel 625A, 625B of the array of pixels 620 is electrically isolated, individually addressable, and includes a layer of one or more nano-carbon materials. In various embodiments, each pixel 625A, 625B of the array of pixels 620 can be connected to a thin film transistor 255 of an array of thin film transistors 250, as shown in FIGS. 2 and 3. The method can also include applying an electrical bias to each thin film transistor of the array of thin film transistors to either enable or disable each pixel 625A, 625B to inject holes at the interface of each pixel 625A, 6258 and the charge transport layer 640. In FIGS. 6A and 6B, the bias applied to the pixel 625A differs from that of the pixel 625B, such that the pixel 625A is able to inject holes but the pixel 625B is unable to inject holes and as a result, surface 641 above the pixel 625B appears more negative and a latent image 670 is generated on the surface 641 of the charge transport layer 640.

According to various embodiments, there is a method of forming an image including forming an electrostatic latent image in accordance with present teachings and providing a development subsystem for converting the latent image 570, 670 to a toner image over the charge transport layer 540, 640 of the electrostatic latent image generator 501D, 601B. The method can also include providing a transfer subsystem for transferring the toner image onto a media and feeding the media through a fuser subsystem to fix the toner image onto the media.

While the present teachings has been illustrated with respect to one or more implementations, alterations and/or modifications can be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." As used herein, the phrase "one or more of", for example, A, B, and C means any of the following: either A, B, or C alone; or combinations of two, such as A and B, B and C, and A and C; or combinations of three A, B and C.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. An electrostatic latent image generator comprising:

a substrate;

an array of pixels disposed over the substrate, wherein each pixel of the array of pixels comprises a layer of one or more nano-carbon materials, and wherein each pixel of the array of pixels is electrically isolated and is individually addressable; and a charge transport layer disposed over the array of pixels, wherein the charge transport layer comprises a surface disposed opposite to the array of pixels, and wherein the charge transport layer is configured to transport holes provided by the one or more pixels to the surface.

2. The electrostatic latent image generator of claim 1 further comprising an array of thin film transistors disposed over the substrate, such that each thin film transistor is connected to one pixel of the array of pixels.

3. The electrostatic image generating member of claim 1, wherein the layer of one or more nano-carbon materials has a surface resistivity in the range of about 50 ohm/sq, to about 5,000 ohm/sq.

4. The electrostatic latent image generator of claim 1, wherein the one or more nano-carbon materials comprises one or more of single-wall carbon nanotubes, double-wall carbon nanotubes, and multi-wall carbon nanotubes.

5. The electrostatic latent image generator of claim 1, wherein the one or more nano-carbon materials comprises graphenes.

6. The electrostatic latent image generator of claim 1, wherein each pixel of the array of pixels has at least one of length and width less than approximately 100 μm.

7. The electrostatic latent image generator of claim 1, wherein the substrate comprises one or more of bi-axially oriented polyethylene terephthalate, polyimide, poly(ethylene napthalate), and flexible glass.

8. The electrostatic latent image generator of claim 1, wherein the charge transport layer comprises a charge transporting small molecule dispersed in an electrically inert polymer.

9. The electrostatic latent image generator of claim 8, wherein the charge transporting small molecule comprises one or more of pyrazolines, diamines, hydrazones, oxadiazoles, stilbenes, and aryl amines.

10. The electrostatic latent image generator of claim 8, wherein the charge transporting small molecule comprises one or more of N,N'-diphenyl-N,N'-bis(alkylphenyl)-1,1'-biphenyl-4,4'-diamine, wherein alkyl is selected from the group consisting of methyl, ethyl, propyl, butyl, or hexyl; N,N'-diphenyl-N,N'-bis(chlorophenyl)-1,1'-biphenyl-4,4'-diamine; N,N'-bis(4-butylphenyl)-N,N'-di-p-tolyl-[p-terphenyl]-4,4"-diamine; N,N'-bis(4-butylphenyl)-N,N'-di-m-tolyl-[p-terphenyl]-4,4"-diamine; N,N'-bis(4-butylphenyl)-N,N'-di-o-tolyl-[p-terphenyl]-4,4"-diamine; N,N'-bis(4-butylphenyl)-N,N'-bis-(4-isopropylpheny)-[p-terphenyl]-4,4"-diamine; N,N'-bis(4-butylphenyl)-N,N'-bis-(2-ethyl-6-methylphenyl)-[p-terphenyl]-4,4"-diamine; N,N'-bis(4-butylphenyl)-N,N'-bis-(2,5-dimethylphenyl)-[p-terphenyl]-4,4'-diamine; and N,N'-diphenyl-N,N'-bis(3-chlorophenyl)-[p-terphenyl]-4,4"-diamine.

11. The electrostatic latent image generator of claim 8, wherein the electrically inert polymer comprises one or more of polycarbonates, polyarylates, acrylate polymers, vinyl polymers, cellulose polymers, polyesters, polysiloxanes, polyamides, polyurethanes, poly(cyclo olefins), polysulfone, and epoxies, and random or alternating copolymers thereof.

12. The electrostatic latent image generator of claim 1 further comprising a hole blocking, layer disposed between the array of pixels and the charge transport layer.

13. The electrostatic latent image generator of claim 1 further comprising one or more adhesion layers disposed either between the substrate and the array of pixel or between the array of pixels and the charge transport layer.

14. A printing apparatus comprising the electrostatic latent image generator of claim 1, wherein the printing apparatus is a xerographic printer.

15. A method of forming an electrostatic latent image comprising:

providing an electrostatic latent image generator, the electrostatic latent image generator comprising an array of pixels disposed over a substrate and a charge transport layer disposed over the array of pixels, wherein each pixel of the array of pixels is electrically isolated, individually addressable, and comprises a layer of one or more nano-carbon materials, creating a negative surface charge on a surface of the charge transport layer, the surface being disposed on a side opposite to the array of pixels; and individually addressing one or more pixels to discharge the negative surface charge on the surface of the charge transport layer corresponding to the one or more pixels, wherein the one or more nano-carbon materials of the one or more addressed pixels inject holes at the interface of the one or more pixels and the charge transport layer and the charge transport layer transports the holes to the surface.

16. The method of forming an electrostatic latent image according to claim 15, wherein the electrostatic latent image generator further comprises an array of thin film transistors disposed over the substrate, such that each thin film transistor is connected to one pixel of the array of pixels.

17. The method of forming an electrostatic latent image according to claim 16, wherein the step of individually addressing one or more pixels further comprises applying an electrical bias to one or more pixels via thin film transistors to either enable hole injection or disable hole injection at the interface of the one or more pixels and the charge transport layer.

18. The method of forming an electrostatic latent image according to claim 15, wherein the one or more nano-carbon materials comprises one or more of single-wall carbon nanotubes, double-wall carbon nanotubes, and multi-wall carbon nanotubes.

19. The method of forming an electrostatic latent image according to claim 15, wherein the one or more nano-carbon materials comprises graphenes.

20. The method of forming an electrostatic latent image according to claim 15, wherein the charge transport layer comprises a charge transporting small molecule dispersed in an electrically inert polymer, wherein the charge transporting small molecule comprises one or more of N,N'-diphenyl-N,N'-bis(alkylphenyl)-1,1'-biphenyl-4,4'-diamine, wherein alkyl is selected from the group consisting of methyl, ethyl, propyl, butyl, or hexyl; N,N'-diphenyl-N,N'-bis(chlorophenyl)-1,1'-biphenyl-4,4'-diamine; N,N'-bis(4-butylphenyl)-N,N'-di-p-tolyl-[p-terphenyl]-4,4"-diamine; N,N'-bis(4-butylphenyl)-N,N'-di-m-tolyl-[p-terphenyl]-4,4"-diamine; N,N'-bis(4-butylphenyl)-N,N'-di-o-tolyl-[p-terphenyl]-4,4"-diamine; N,N'-bis(4-butylphenyl)-N,N'-bis-(4-isopropylphenyl)-[p-terphenyl]-4,4"-diamine; N,N-bis(4-butylphenyl)-N,N'-bis-(2-ethyl-6-methylphenyl)-[p-terphenyl]-4,4"-diamine; N,N'-bis(4-butylphenyl)-N,N'-bis-(2,5-dimethylpheny)-[p-terphenyl]-4,4'-diamine; and N,N'-diphenyl-N,N'-bis(3-chlorophenyl)-[p-terphenyl]-4,4"-diamine; and wherein the electrically inert polymer comprises one or more of polycarbonates, polyarylates, acrylate polymers, vinyl polymers, cellulose polymers, polyesters, polysiloxanes, polyamides, polyurethanes, poly(cyclo olefins), polysulfone, and epoxies, and random or alternating copolymers thereof.

21. A method of forming an image comprising:

forming an electrostatic latent image according to claim 15;

providing a development subsystem for converting the latent image to a toner image over the charge transport layer of the electrostatic latent image generator;

providing a transfer subsystem for transferring the toner image onto a media; and feeding the media through a fuser subsystem to fix the toner image onto the media.

22. The method of claim 15, wherein the layer of one or more nano-carbon materials has a surface resistivity in the range of about 50 ohm/sq. to about 5,000 ohm/sq.

23. A method of forming an electrostatic latent image comprising:

providing an electrostatic latent image generator, the electrostatic latent image generator comprising an array of pixels disposed over a substrate and a charge transport layer disposed over the array of pixels, wherein each pixel of the array of pixels is electrically isolated, individually addressable, and comprises a layer of one or more nano-carbon materials, and wherein each pixel of the array of pixels is connected to a thin film transistor of an array of thin film transistors, and applying an electrical bias to each thin film transistor of the array of thin film transistors to either enable or disable each pixel to inject holes at the interface of each pixel and the charge transport layer, such that a surface negative charge develops at the surface of the charge transport layer corresponding to the disabled pixel.

24. The method of claim 23, wherein the layer of one or more nano-carbon materials has a surface resistivity in the range of about 50 ohm/sq. to about 5,000 ohm/sq.

* * * * *